US007453314B2

(12) United States Patent
Hwang et al.

(10) Patent No.: US 7,453,314 B2
(45) Date of Patent: Nov. 18, 2008

(54) TEMPERATURE-INDEPENDENT CURRENT SOURCE CIRCUIT

(75) Inventors: Jong-Tae Hwang, Seoul (KR); Dong-Hwan Kim, Bucheon (KR); Yun-Kee Lee, Bucheon (KR)

(73) Assignee: Fairchild Korea Semiconductor, Ltd., Bucheon (KR)

( * ) Notice: Subject to any disclaimer, the term of this patent is extended or adjusted under 35 U.S.C. 154(b) by 0 days.

(21) Appl. No.: 11/447,586

(22) Filed: Jun. 5, 2006

(65) Prior Publication Data

US 2006/0220733 A1 Oct. 5, 2006

Related U.S. Application Data

(62) Division of application No. 10/833,693, filed on Apr. 28, 2004, now Pat. No. 7,057,442.

(30) Foreign Application Priority Data

May 23, 2003 (KR) ..... 2003/32911

(51) Int. Cl.
*G05F 1/10* (2006.01)

(52) U.S. Cl. ..... 327/538; 327/575

(58) Field of Classification Search ..... 323/315; 327/535, 538, 543, 575

See application file for complete search history.

(56) References Cited

U.S. PATENT DOCUMENTS

| | | | | |
|---|---|---|---|---|
| 4,467,289 | A | 8/1984 | Okada | |
| 4,639,684 | A * | 1/1987 | Laude | 330/259 |
| 4,687,984 | A | 8/1987 | Butler | |
| 5,675,243 | A | 10/1997 | Kamata | |
| 5,859,568 | A * | 1/1999 | Le et al. | 330/289 |
| 7,057,442 | B2 | 6/2006 | Hwang et al. | |

* cited by examiner

*Primary Examiner*—Jeffrey Zweizig
(74) *Attorney, Agent, or Firm*—Sidley Austin LLP

(57) ABSTRACT

A temperature-independent current source is provided, which includes a current source generating a current that is proportional to the temperature and a current source generating a current that is inversely proportional to the temperature. Values of the circuit elements are selected so that the currents of the current sources add up to a substantially temperature-independent current. Related current sources utilize dual-base Darlington bipolar transistors to generate a temperature-independent current.

8 Claims, 6 Drawing Sheets

TEMPERATURE-INDEPENDENT CURRENT SOURCE CIRCUIT

CROSS REFERENCE TO RELATED APPLICATION

The present application is a divisional of application Ser. No. 10/833,693, filed Apr. 28, 2004, now U.S. Pat. No. 7,057,442, which is based on Korean Patent Application No. 2003-32911, filed on May 23, 2003 in the Korean Intellectual Property Office, the content of which is incorporated herein by reference in its entirety.

BACKGROUND OF THE INVENTION (a) Field of the Invention

The present invention relates to current sources. More specifically, the present invention relates to a temperature-independent current source circuits.

(b) Description of the Related Art

A voltage source and a current source are essential circuit components in analog circuits. Voltage and current sources should generate substantially constant voltage and current even if surrounding environmental factors change. For example, voltage and current sources should not influenced by the variations of the load and the temperature, thus enabling a stable operation of the system. In particular, essentially temperature-independent currents should be supplied to elements, which may be sensitive to temperature variations, such as transistors.

Exisiting circuits are illustrated in FIGS. 1(*a*) and 1(*b*), showing a PTAT (proportional to absolute temperature) current source and an NTAT (inversely proportional to absolute temperature) current source.

Referring to FIG. 1(*a*), a PTAT source includes two transistors Q1 and Q2, a resistor R1, and a current mirror. The collector currents of transistors Q1 and Q2 are essentially the same when the current ratio of the current mirror is equal to one. Values of the collector currents are given:

$$IPTAT = \frac{VT}{R1}\ln N = \frac{k \cdot T}{q \cdot R1}\ln N \tag{1}$$

where IPTAT is a value that corresponds to the collector current of the transistor, VT is a thermal voltage: VT=kT/q with a value of about 25 mV at room temperature (the room temperature is 27° C., corresponding to an absolute temperature of 300K), N is a ratio of the emitter area of the transistors Q1 and Q2, q is the absolute value of the charge of an electron, k is Boltzmann's constant, and T is the absolute temperature. A possible realization is illustrated in FIG. 1(*a*), representing a current source that outputs a current that is substantially proportional to the absolute temperature since IPTAT is proportional to the absolute temperature T.

Referring to FIG. 1(*b*), a current source that outputs a current that is inversely proportional to the absolute temperature T includes two transistors Q3 and Q4, a resistor R2, and a current mirror 10. Current mirror 10 of FIG. 1(*b*) has the same function as that of the current mirror of FIG. 1(*a*). Since the ratio of the input and output of the current mirror is essentially one, the values of the collector currents of transistors Q3 and Q4 are the same. This collector current value is determined by transistor Q3 and resistor R2:

$$INTAT = \frac{VBE}{R2} \tag{2}$$

where INTAT is the collector current of transistors Q3 and Q4 and VBE is a base-emitter voltage of transistor Q3, which can be a bipolar transistor. Since VBE decreases as the temperature increases, VBE is reduced by about −2 mV when a junction temperature is increased by about 1 degree. Accordingly, the circuit of FIG. 1(*b*) is an NTAT current source as described by Equation (2).

As described by Equations (1) and (2), the current sources of FIGS. 1(*a*) and 1(*b*) are influenced by the temperature.

Temperature-independent current sources have been created in the past by combining a PTAT current source and an NTAT current source, as described in U.S. Pat. Nos. 6,310,510 and 6,023,185. U.S. Pat. No. 6,310,510 described a circuit functioning as an NTAT current source and a circuit functioning as a PTAT current source, and combined them into a temperature-independent current source, thereby requiring a lot of circuit elements, increasing the cost. This architecture also lowers the quality of the current source because of a problem of matching both circuits. This matching problem leads to an increased sensitivity of the output current to the temperature. Further, U.S. Pat. No. 6,023,185 requires a band gap reference.

SUMMARY OF THE INVENTION

Embodiments of the present invention include essentially temperature-independent high quality current sources, employing a simple circuit design. In particular, embodiments of the invention do not require a band gap reference.

In one aspect of the present invention, a current source includes: a first transistor having a first terminal for receiving a first current, and a grounded second terminal; a second transistor having a first terminal for outputting a predetermined part of a second current, a second terminal grounded through a first resistor, and a control terminal coupled to a control terminal of the first transistor. The current source further includes a third transistor having a first terminal coupled to the first terminal of the second transistor, for outputting a residual part of the second current, a second terminal coupled to the control terminal of the second transistor, and a control terminal coupled to the first terminal of the first transistor; and a second resistor coupled between the control terminal of the first and second transistors and the ground.

An essentially temperature-independent current is generated at the output terminal of the current mirror by controlling a size ratio of the first and second transistors, and choosing the first and second resistors appropriately.

In another aspect of the present invention, a current source comprises: a first transistor having a first terminal for receiving a first current, and a second transistor having a control terminal coupled to a control terminal of the first transistor, a first terminal for outputting a predetermined part of a second current, and a second terminal grounded through a first resistor, wherein the first and second transistors and the first resistor generate a current that is proportional to the temperature at the first terminal of the second transistor. The current source further includes a third transistor having a control terminal coupled to the first terminal of the first transistor, a second terminal coupled to a control terminal of the first transistor, functioning as a buffer, and a first terminal coupled to the first terminal of the second transistor for outputting a residual part of the second current. Additionally the first transistor and a second resistor that is coupled between the control terminal of the first transistor and the ground, generate a current that is inversely proportional to the temperature at the first terminal of the third transistor. In this current source the first current and the second current are essentially independent of the temperature.

In still another aspect of the present invention, a current source includes a first Darlington transistor having a first terminal for receiving a first current, a grounded second terminal, and a control terminal coupled to the first terminal, and a second Darlington transistor having a first terminal for outputting a second current, a second terminal grounded through a first resistor, and first and second control terminals respectively coupled to the first and second control terminals of the first Darlington transistor.

BRIEF DESCRIPTION OF THE DRAWINGS

The accompanying drawings illustrate various embodiments of the invention, and, together with the description, serve to explain the principles of the invention.

FIG. 1(*b*) shows a configuration of a conventional NTAT current source.

FIG. 3(*b*) shows a symbol diagram of the dual base Darlington bipolar transistor shown in FIG. 3(*a*).

DETAILED DESCRIPTION

The following detailed description is given simply by way of illustration of the invention. A large number of modifications can be perceived by persons skilled in the arts, all without departing from the invention. Accordingly, the drawings and description are to be regarded as illustrative in nature and not restrictive.

Figure 2:
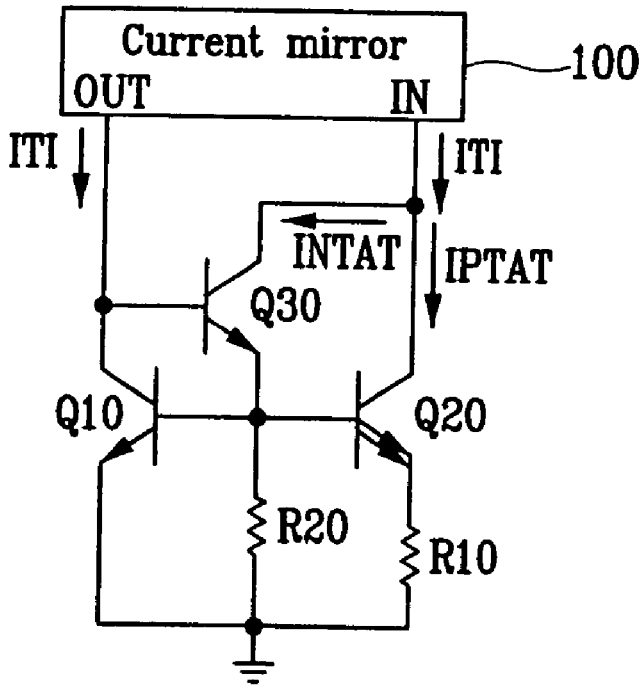
FIG. 2 shows a configuration of a temperature-independent current source according to an embodiment of the invention.

FIG. 2 shows a configuration of a TI (temperature-independent) current source according to an embodiment of the invention.

As shown, the TI current source comprises three transistors Q10, Q20, and Q30, two resistors R10 and R20, and a current mirror 100 for mirroring an input current from an input port to an output port. The current ratio of the input current and the output current is approximately one.

The bases of transistors Q10 and Q20 are coupled and the base and the emitter of transistor Q30 are coupled to the collector and the base of transistor Q10. Therefore, transistors Q10 and Q20 and resistor R10 function as a PTAT current source, in analogy to the one described in relation to FIG. 1(*a*).

Figure 1A:
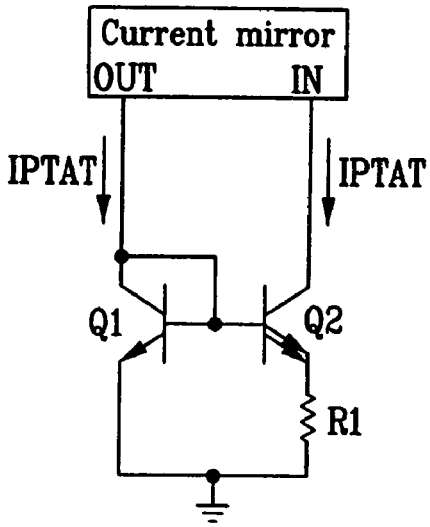
FIG.1A(Prior Art)
FIG. 1(*a*) shows a configuration of a conventional PTAT current source.
Figure 1B:
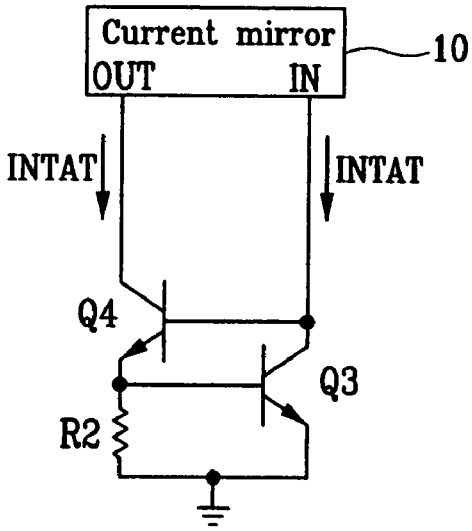
FIG.1B(Prior Art)

The base and collector of transistor Q10 are coupled to the emitter and base of transistor Q30 and accordingly, transistors Q10 and Q30 and resistor R20 function as the NTAT current source described in relation to FIG. 1(*b*). One of the functions of transistor Q30 is to be a buffer for the circuit-part that produces the PTAT current source. Another function is to provide a predetermined part of the NTAT current for the circuit-part that functions as the NTAT current source. Hence, the collector current INTAT of transistor Q30 from the part that produces the NTAT current source is given by Equation (2).

The TI (temperature independent) current source according to an embodiment of the invention includes the combination of the circuit-part that functions as the PTAT current source and the circuit-part that functions as the NTAT current source. The collector currents of transistors Q20 and Q30 are the currents of the PTAT current source and the NTAT current source, respectively. The currents INTAT and IPTAT of the NTAT and PTAT current sources are combined and the combined current is mirrored to the collector of transistor Q10 by current mirror 100. The mirrored collector current of transistor Q10 is an essentially temperature independent current.

Since the TI current source is the combination of the currents of the PTAT current source and the NTAT current source, the current of the TI current source is given as:

$$ITI=IPTAT+INTAT \tag{3}$$

where ITI is the current of the TI current source, and IPTAT and INTAT are the currents of the PTAT and NTAT current sources, respectively. The temperature independence of ITI can be seen by performing partial differentiation on Equation (3) with respect to the temperature:

$$\begin{aligned}\frac{\partial ITI}{\partial T} &= \frac{\partial IPTAT}{\partial T} + \frac{\partial INTAT}{\partial T} \\ &= \ln N\left(\frac{1}{R1}\frac{\partial VT}{\partial T} - \frac{VT}{R1^2}\frac{\partial R1}{\partial T}\right) + \left(\frac{1}{R2}\frac{\partial VBE}{\partial T} - \frac{VBE}{R2^2}\frac{\partial R2}{\partial T}\right) \\ &= \frac{VT}{R1}\ln N\Big|_{T=300K}\cdot\left(\frac{1}{VT}\frac{\partial VT}{\partial T} - \frac{1}{R1}\frac{\partial R1}{\partial T}\right) + \frac{VBE}{R2}\Big|_{T=300K}\cdot \\ &\quad \left(\frac{1}{VBE}\frac{\partial VBE}{\partial T} - \frac{1}{R2}\frac{\partial R2}{\partial T}\right)\end{aligned} \tag{4}$$

Here:

$$\frac{VT}{R1}\ln N\Big|_{T=300K} = IPTAT,0 \tag{5}$$

where the value of the IPTAT at room temperature of 300K is denoted as IPTAT,0.

Further:

$$\frac{1}{VT}\frac{\partial VT}{\partial T} = TC,VT \tag{6}$$

and:

$$\frac{1}{VBE}\frac{\partial VBE}{\partial T} = TC,VBE \tag{7}$$

where the value of INTAT at room temperature of 300K is denoted as INTAT,0.

and:

$$\frac{VBE}{R2}\Big|_{T=300K} = INTAT,0 \tag{8}$$

Finally:

$$\frac{1}{R1}\frac{\partial R1}{\partial T} = \frac{1}{R2}\frac{\partial R2}{\partial T} = TC,R \tag{9}$$

Substituting the expressions from Equations (5) to (9) into Equation (4) gives a final form for the temperature derivative of the ITI current with respect to the temperature. If this derivative is zero, then ITI is independent of the temperature.

$$\begin{aligned}\frac{\partial ITI}{\partial T} &= IPTAT,0(TC,VT - TC,R) + \\ &\quad INTAT,0(TC,VBE - TC,R) \\ &= 0\end{aligned} \tag{10}$$

One can also determine the ratio of IPTAT,0 relative to INTAT,0:

$$\frac{IPTAT,0}{INTAT,0} = \frac{TC,R - TC,VBE}{TC,VT - TC,R} \tag{11}$$

By using Equations (5), (7), and (11) the ratio of the sizes of transistors Q10 and Q20, N, and the values of the resistors R10 and R20 are found to satisfy Equation (10).

Temperature-independent current sources can be implemented by using simple circuits depicted in FIG. 2. However, temperature dependencies of the parameters of transistors Q10, Q20, and 30 are different, and hence, it is difficult to find a value N that satisfies Equation (10), and to find suitable values of resistors R10 and R20.

Figure 3A:
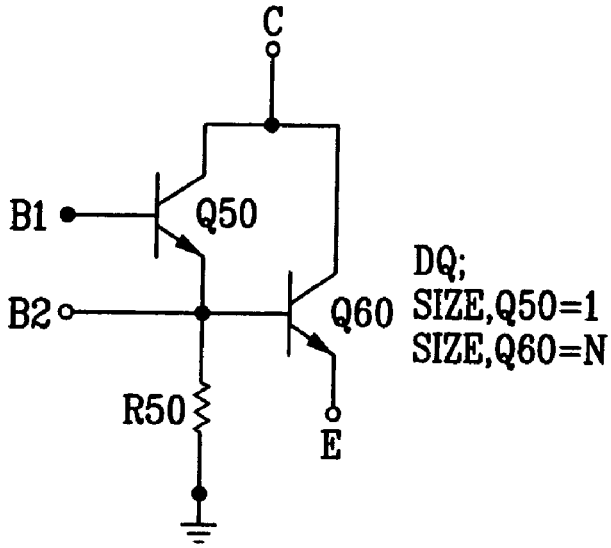
FIG. 3(*a*) shows a dual base Darlington bipolar transistor included in a temperature-independent current source circuit according to an embodiment of the invention.
Figure 3B:
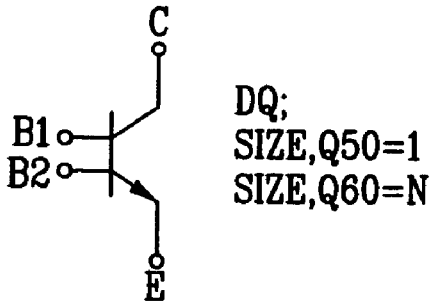
Figure 4:
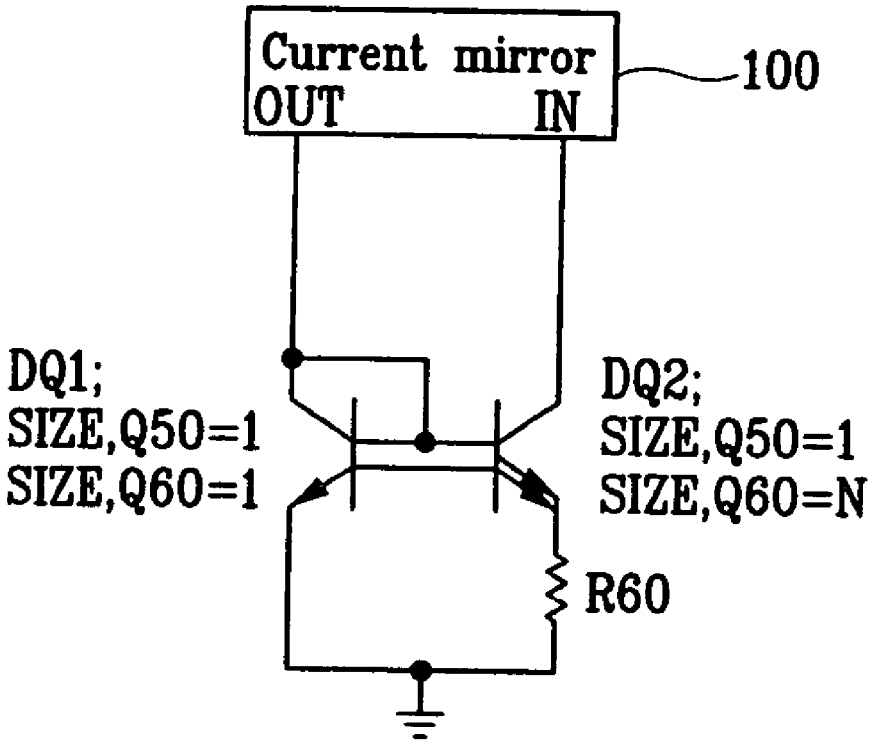
FIG. 4 shows a configuration of a temperature-independent current source according to an embodiment of the invention.
Figure 5:
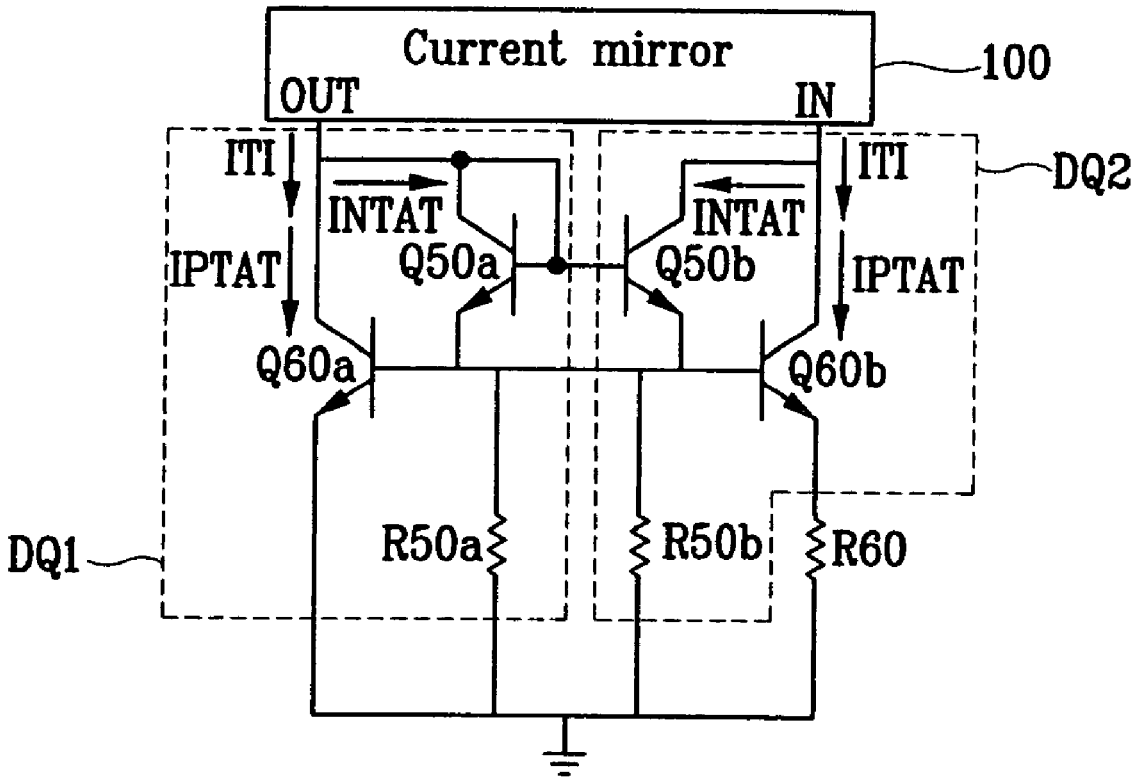
FIG. 5 shows a detailed diagram of FIG. 4.

FIGS. 3-5 illustrate temperature independent current sources according to embodiments of the invention.

FIG. 3(*a*) shows a DB2T (dual-base Darlington bipolar transistor) included in a temperature-independent current source circuit. FIG. 3(*b*) illustrates a symbol of the DB2T shown in FIG. 3(*a*).

As shown in FIG. 3(*a*), the DB2T comprises two transistors Q50 and Q60, and a resistor R50. The collectors of transistors Q50 and Q60 are coupled, the emitter of transistor Q50 is coupled to the base B2 of transistor Q60, and resistor R50 is coupled to the base B2 of transistor Q60.

A function of transistor Q50 is to generate a NTAT current, and a function of transistor Q60 is to generate a PTAT current. Resistor R50 and the VBE (a voltage of the base with respect to the emitter) value of transistor Q60 determine the amount of the INTAT. The DB2T has two parameters, which include an emitter size (referred to as SIZE,Q50 hereinafter) of transistor Q50 and an emitter size (referred to as SIZE,Q60 hereinafter) of transistor Q60. In general, the parameter SIZE,Q60 is greater than the parameter SIZE,Q50.

FIG. 4 illustrates another current source according to an embodiment of the invention. The temperature-independent current source comprises two DB2Ts: DQ1 and DQ2, a resistor R60, and current mirror 100.

DQ1, DQ2, resistor R60, and current mirror 100 have similar functions as those described in relation to FIGS. 2 and 3. The collector of DQ1 is coupled to the first base B1 of DQ2, the two bases B1 and B2 of DQ1 are respectively coupled to the two bases B1 and B2 of DQ2, and resistor R60 is coupled between the emitter of DQ1 and the ground.

FIG. 5 shows a diagram of FIG. 4 in some detail. Transistor Q60*a* in DQ1, transistor Q60*b* in DQ2, the coupled second bases of DQ1 and DQ2, and resistor R60 function as the PTAT current source. The size of the emitter of DQ2 is N times larger than that of the other transistors as shown in FIG. 4. The N-times size difference and the value of the resistor R60 determines the IPTAT current.

Transistor Q50*a* in DQ1, transistor Q50*b* in DQ2, the collector of DQ1, coupled to the first base of DQ1 (i.e., the base of transistor Q50*a*), the coupled first bases of DQ1 and DQ2, and resistors R50*a* and R50*b* function as the NTAT current source. The INTAT current is determined by the values of resistors R50*a* and R50*b* and the respective VBE values of transistors Q50*a* and Q50*b*.

The sum of IPTAT and INTAT is ITI, the current of the temperature-independent current source, as shown by Equation (3). The values of resistors R60, R50*a*, and R50*b*, and the value of N are chosen so that Equation (10) is satisfied. With this choice of parameters the circuit of FIG. 5 describes a temperature-independent current source.

Figure 6:
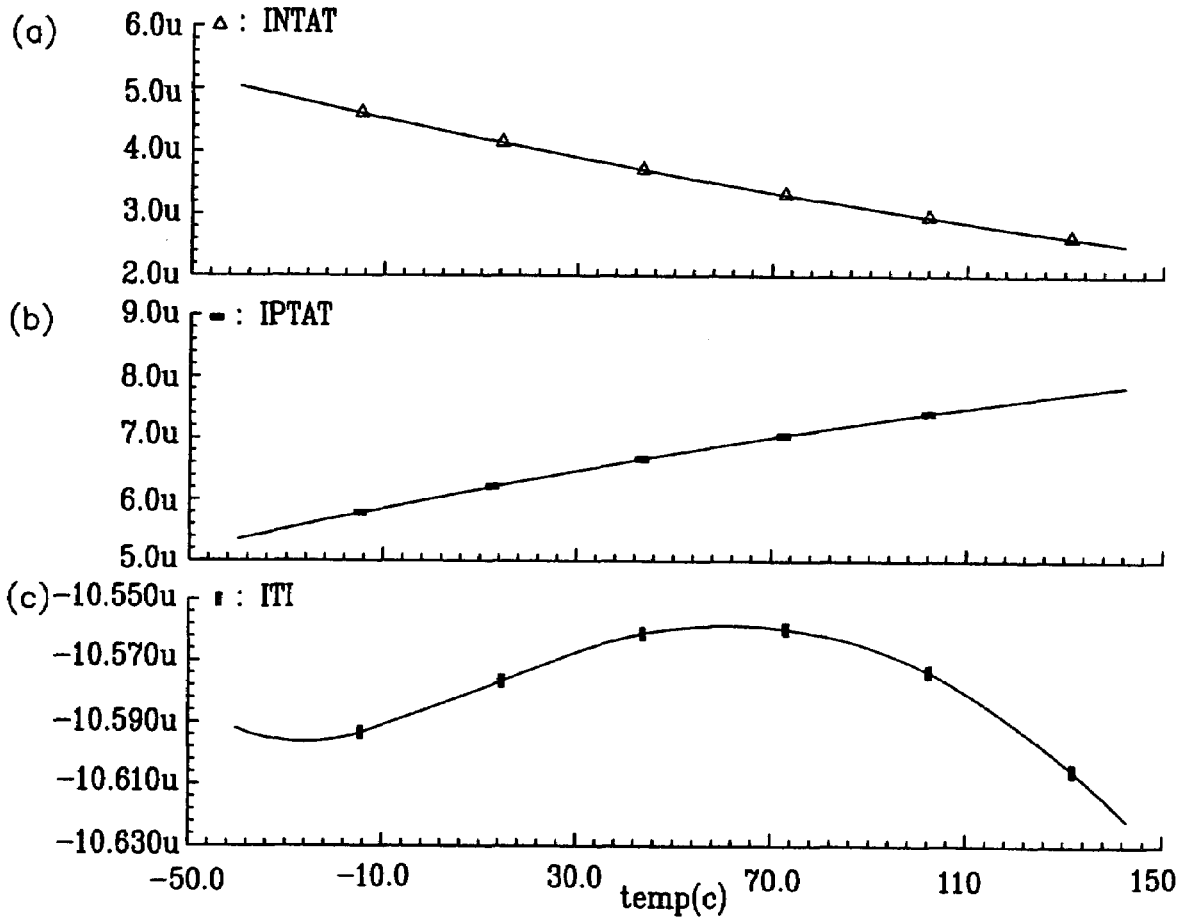
FIGS. 6(*a*)-(*c*) show a simulation of the temperature dependence of a current in an embodiment of the invention.

FIGS. 6(*a*)-(*c*) show the results of a simulation of the temperature dependence of the currents INTAT, IPTAT and ITI. FIG. 6(*a*) displays INTAT as a function of the temperature, FIG. 6(*b*) shows IPTAT, and FIG. 6(*c*) shows ITI as a function of the temperature in the range of −40 degree to 150 degree.

FIG. 6(*a*) shows that INTAT is inversely proportional to the temperature. FIG. 6(*b*) shows that IPTAT is proportional to the temperature. FIG. 6(*c*) illustrates that ITI exhibits a variation of 0.63% in the temperature range of −40 degree and 150 degree. This value of the ITI variation is lower than that of exisiting circuits.

It is understood that the invention is not limited to the disclosed embodiments, but, on the contrary, is intended to cover various modifications and equivalent arrangements included within the spirit and scope of the appended claims.

For example, NPN bipolar junction transistors were described in some embodiments, but corresponding circuits with PNP transistors, SiGe BJTs, or HBTs can also be used. Further, equivalent circutis utilizing MOS transistors, biased in the weak inversion region can be used as well.

An aspect of the invention is that the circuit-part that functions as the NTAT current source and the circuit-part that functions as the PTAT current source are realized in an integrated manner, without realizing each circuit separately and then combining them. This aspect is partially responsible for the current source having a simpler circuit, yet exhibiting an improved performance.

What is claimed is:

1. A current source comprising:

a first Darlington transistor having a first terminal for receiving a first current, a grounded second terminal, and first and second control terminals wherein the first control terminal is coupled to the first terminal; and a second Darlington transistor having a first terminal for outputting a second current, a second terminal grounded through a first resistor, and first and second control terminals respectively coupled to the first and second control terminals of the first Darlington transistor.

2. The current source of claim 1, further comprising a current mirror having an input terminal coupled to the first terminal of the second Darlington transistor, and an output terminal coupled to the first terminal of the first Darlington transistor, for mirroring the second current to the first current.

3. The current source of claim 2, wherein:

the first Darlington transistor comprises a first transistor, a second transistor, and a second resistor, wherein the first terminals of the first and second transistors are coupled;

the second terminal of the first transistor is coupled to the control terminal of the second transistor; and the second terminal of the first transistor is grounded through the second resistor so that the first Darlington transistor has two control terminals; and the second Darlington transistor comprises a third transistor, a fourth transistor, and a third resistor, wherein the first terminals of the third and fourth transistors are coupled;

the second terminal of the third transistor is coupled to the control terminal of the fourth transistor; and the second terminal of the third transistor is grounded through the third resistor so that the second Darlington transistor has two control terminals.

4. The current source of claim 3, wherein the first, second, third, and fourth transistors are bipolar transistors, the first terminals are collectors, the second terminals are emitters, and the control terminals are bases.

5. The current source of claim 4, wherein the first and third transistors and the second and third resistors are operable to generate a current that is substantially inversely proportional to the temperature at the collectors of the first and third transistors; and the second and fourth transistors and the first resistor are operable to generate a current that is substantially proportional to the temperature at the collectors of the second and fourth transistors.

6. The current source of claim 4, wherein an emitter size of the fourth transistor is substantially N times greater than emitter sizes of the transistors different from the fourth transistor.

7. The current source of claim 6, wherein a substantially temperature-independent current is supplied to an output terminal of the current mirror by selecting the emitter size of the fourth transistor and the values of the first, second, and third resistors.

8. The current source of claim 2, wherein an input current and an output current of the current mirror are substantially the same.

* * * * *